US007104082B1

(12) United States Patent
Moratalla

(10) Patent No.: US 7,104,082 B1
(45) Date of Patent: Sep. 12, 2006

(54) DEHUMIDIFICATION AND TEMPERATURE CONTROL SYSTEM

(76) Inventor: Jose Moratalla, 738 Heathrow La., Palm Harbor, FL (US) 34683

( * ) Notice: Subject to any disclaimer, the term of this patent is extended or adjusted under 35 U.S.C. 154(b) by 335 days.

(21) Appl. No.: 10/360,487

(22) Filed: Feb. 6, 2003

(51) Int. Cl.
*F24F 7/00* (2006.01)
*F25D 23/00* (2006.01)
*F25D 17/06* (2006.01)

(52) U.S. Cl. ..... 62/271; 62/94; 62/93; 165/8; 165/9; 236/49.3

(58) Field of Classification Search ..... 165/222, 165/59, 8, 9; 62/93, 271, 94; 236/49.3
See application file for complete search history.

(56) References Cited

U.S. PATENT DOCUMENTS 3,171,401 A * 3/1965 McDuffee ..... 126/113
4,044,950 A * 8/1977 Engeling et al. ..... 237/55
4,716,957 A * 1/1988 Thompson et al. ..... 165/209
5,325,676 A * 7/1994 Meckler ..... 62/93
5,353,606 A * 10/1994 Yoho et al. ..... 62/271
5,373,704 A * 12/1994 McFadden ..... 62/94
5,426,953 A * 6/1995 Meckler ..... 62/271
5,502,975 A * 4/1996 Brickley et al. ..... 62/94
5,548,970 A * 8/1996 Cunningham et al. ..... 62/271
5,595,238 A * 1/1997 Mark et al. ..... 165/8
5,653,115 A * 8/1997 Brickley et al. ..... 62/94
5,758,511 A * 6/1998 Yoho et al. ..... 62/271
5,826,641 A * 10/1998 Bierwirth et al. ..... 165/48.1
5,931,016 A * 8/1999 Yoho, Sr. ..... 62/271
6,050,100 A * 4/2000 Belding et al. ..... 62/271
6,557,365 B1 * 5/2003 Dinnage et al. ..... 62/271
6,751,964 B1 * 6/2004 Fischer ..... 62/94

* cited by examiner

*Primary Examiner*—John K. Ford
(74) *Attorney, Agent, or Firm*—Edward P. Dutkiewicz

(57) ABSTRACT

A space has air humidity and temperature to be regulated. An air handler has a temperature regulation element, a fan and a housing. An inflow manifold has an intake end and an outflow end and a plurality of stubs and a plurality of dampers. An outflow manifold has an intake end and an outflow end and a plurality of stubs and a plurality of dampers. A desiccant unit has a plurality of chambers and a desiccant wheel and a plurality of blowers and a heat source and a mixing chamber and a combustible gas supply with a gas burner and an adjustable gas valve to regulate the flow of combustible gas. A plurality of ducts couple the air handler and the manifolds and the desiccant unit.

2 Claims, 22 Drawing Sheets

BURNER BY-PASS
COOL DOWN PURGE

DEHUMIDIFICATION AND TEMPERATURE CONTROL SYSTEM

BACKGROUND OF THE INVENTION

1. Field of the Invention

The present invention relates to a dehumidification and temperature control system and more particularly pertains to controlling humidity and temperature independently and on demand without overcooling.

2. Description of the Prior Art

The use of dehumidification and cooling systems of known designs and configurations is known in the prior art. More specifically, dehumidification and cooling systems of known designs and configurations previously devised and utilized for the purpose of dehumidifying and cooling spaces are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art does not describe a desiccant dehumidification and temperature control system that allows controlling humidity and temperature independently and on demand without overcooling.

In this respect, the desiccant dehumidification and temperature control system according to the present invention substantially departs from the conventional concepts and designs of the prior art, and in doing so provides an apparatus primarily developed for the purpose of controlling humidity and temperature independently and on demand without overcooling.

Therefore, it can be appreciated that there exists a continuing need for a new and improved desiccant dehumidification and temperature control system which can be used for controlling humidity and temperature independently and on demand without overcooling. In this regard, the present invention substantially fulfills this need.

SUMMARY OF THE INVENTION

In view of the foregoing disadvantages inherent in the known types of dehumidification and cooling systems of known designs and configurations now present in the prior art, the present invention provides an improved desiccant dehumidification and temperature control system. As such, the general purpose of the present invention, which will be described subsequently in greater detail, is to provide a new and improved desiccant dehumidification and temperature control system and method which has all the advantages of the prior art and none of the disadvantages.

To attain this, the present invention essentially comprises a space to have air humidity and temperature regulated independently. An air handler has a temperature regulation element and a fan and a housing. The element and the fan are contained within the housing. The housing has an inflow opening and an outflow opening.

Next provided is an inflow manifold. The inflow manifold has a generally hollow configuration for allowing the passage of gases there through. The manifold has an intake end and an outflow end. There is an ambient air intake stub located at the outermost end of the intake end. The ambient air intake stub has a outermost grill and a filter and an innermost damper. The damper is mechanically controlled by a sensing device motor, actuator or airflow.

The intake end of the manifold also has a return air stub. The return air stub has an outer grill and an inner filter. The intake end of the manifold has a desiccant inflow connection stub with a mechanically controlled damper. The intake end of the manifold also has a desiccant bypass inflow connection stub with a mechanically controlled damper. The inflow manifold is coupled with the air handler.

Next provided is an outflow manifold having a generally hollow configuration for allowing the passage of gases there through. The outflow manifold has an intake end that is coupled to the air handler. There is a desiccant supply stub located on the intake end. The outflow end has a stub with the outflow end being coupled to the interior of a space. There is a mechanically controlled damper located within the outflow manifold to provided air flow control through that manifold.

The outflow manifold has a desiccant supply stub that has a mechanically controlled damper located near the air handler. There is a desiccant return stub that has a mechanically controlled damper. The stub is located between the damper and the interior of a room.

Next provided is a desiccant unit having a housing with an upper processing chamber and a parallel lower regeneration chamber. Each chamber is separated from the other chamber by an interior wall. The interior wall has a wheel aperture there through. The unit has a desiccant wheel coupled to an axle. The axle is coupled to the interior wall to position the wheel within each of the chambers and to allow for the rotation of the wheel.

The wheel has a drum portion and a pair of outermost flanges and two flat parallel faces forming a thickness there between. There is a plurality of desiccant coated air passageways located perpendicular to the flat faces that form a plurality of passageways through the thickness of the wheel. The passageways allow the passage of gases there through.

The wheel drum has a linked chain coupled there to. The wheel also has a round ring seal to seal off each of the chambers from the other. Each chamber has a plurality of wheel seal mounting portions. Each mounting portion has a plurality of spring mounted seats.

The interior wall has a plurality of surface seals to contact the wheel face to provide a seal between the chambers. The unit has an electro-mechanical motor and a motor axle and a sprocket sized to mate with the linked chain to provide a means for turning the wheel about the wheel axle.

The upper processing chamber has a Y-shaped inflow stub and a Y-shaped outflow stub. One branch of the Y-shaped inflow stub couples to the intake end stub of the outflow manifold and the other branch of the Y-shaped inflow stub couples with the desiccant inflow connection stub. One branch of the Y-shaped outflow stub is coupled to the outflow end of the outflow manifold.

The wheel is located at about the midpoint of the chamber. An electro-mechanical blower located between the wheel and the inflow stub. There is a gas pressurizing aperture into the upper chamber which allows the delivery of pressurized air into a pipe.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved desiccant dehumidification and temperature control system which has all of the advantages of the prior art systems and none of the disadvantages.

It is another object of the present invention to provide a new and improved desiccant dehumidification and temperature control system which may be easily and efficiently manufactured and marketed.

It is further an object of the present invention to provide a new and improved desiccant dehumidification and temperature control system which is of durable and reliable constructions.

An even further object of the present invention is to provide a new and improved desiccant dehumidification and temperature control system which is susceptible of a low cost of manufacture with regard to both materials and labor, and which accordingly is then susceptible of low prices of sale to the consuming public, thereby making such desiccant dehumidification and temperature control system economically available to the buying public.

Even still another object of the present invention is to provide a desiccant dehumidification and temperature control system for controlling humidity and temperature independently and on demand without overcooling.

Lastly, it is an object of the present invention to provide a regulated space with a new and improved air humidity and temperature control system. An air handler has a temperature regulation element, a fan and a housing. An inflow manifold has an intake end and an outflow end and a plurality of stubs and a plurality of dampers. An outflow manifold has an intake end and an outflow end and a plurality of stubs and a plurality of dampers. A desiccant unit has a plurality of chambers and a desiccant wheel and a plurality of blowers and a heat source and a mixing chamber and a combustible gas supply with a gas burner and an adjustable gas valve to regulate the flow of combustible gas. A plurality of ducts couple the air handler and the manifolds and the desiccant unit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a side elevation cross sectional view of the system with the bypass duct eliminated, showing the flow of air when in a Supply to Supply mode with air handler on.

The same reference numerals refer to the same parts throughout the various Figures.

DESCRIPTION OF THE PREFERRED EMBODIMENT

Figure 1:
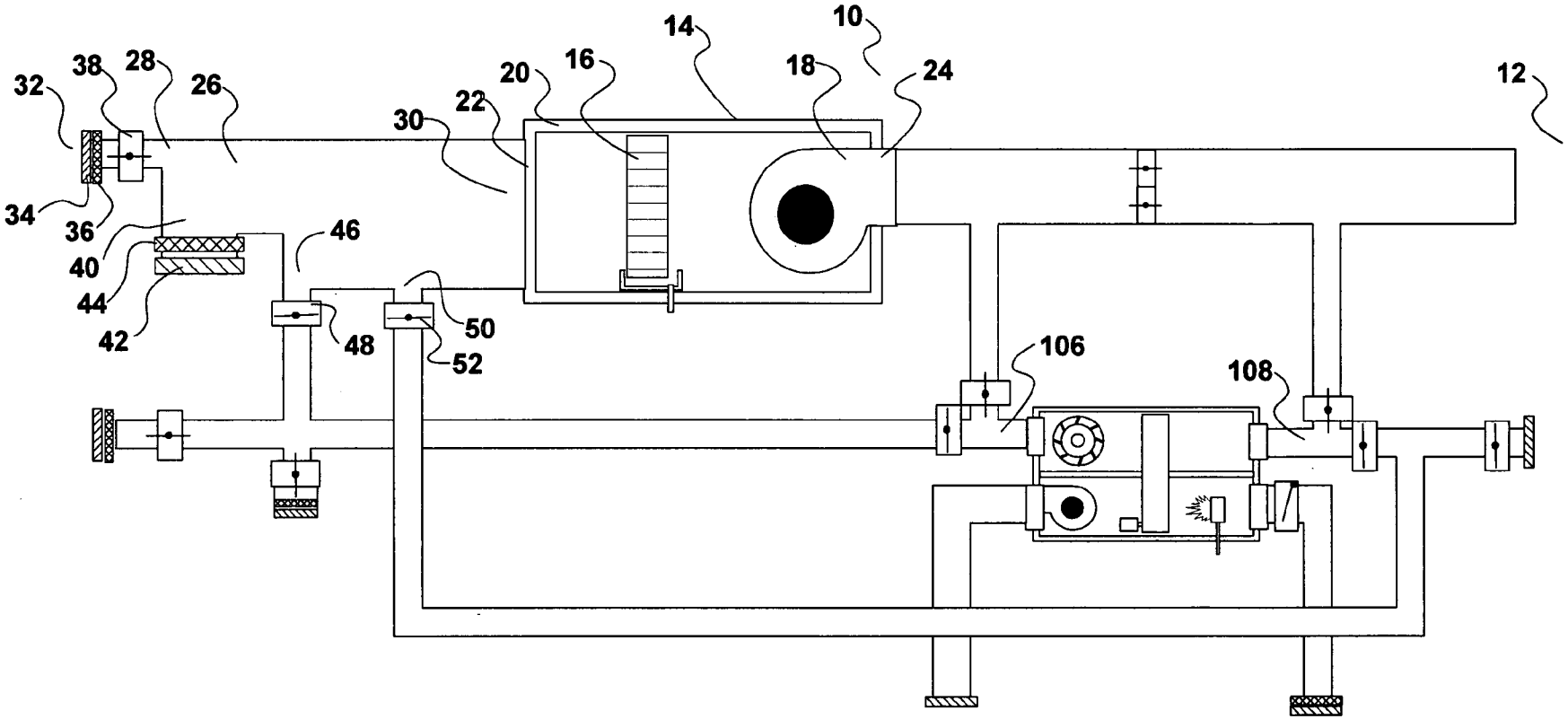
FIG. 1 is a side elevation cross sectional view of the system showing the elements in relation with one another.
Figure 2:
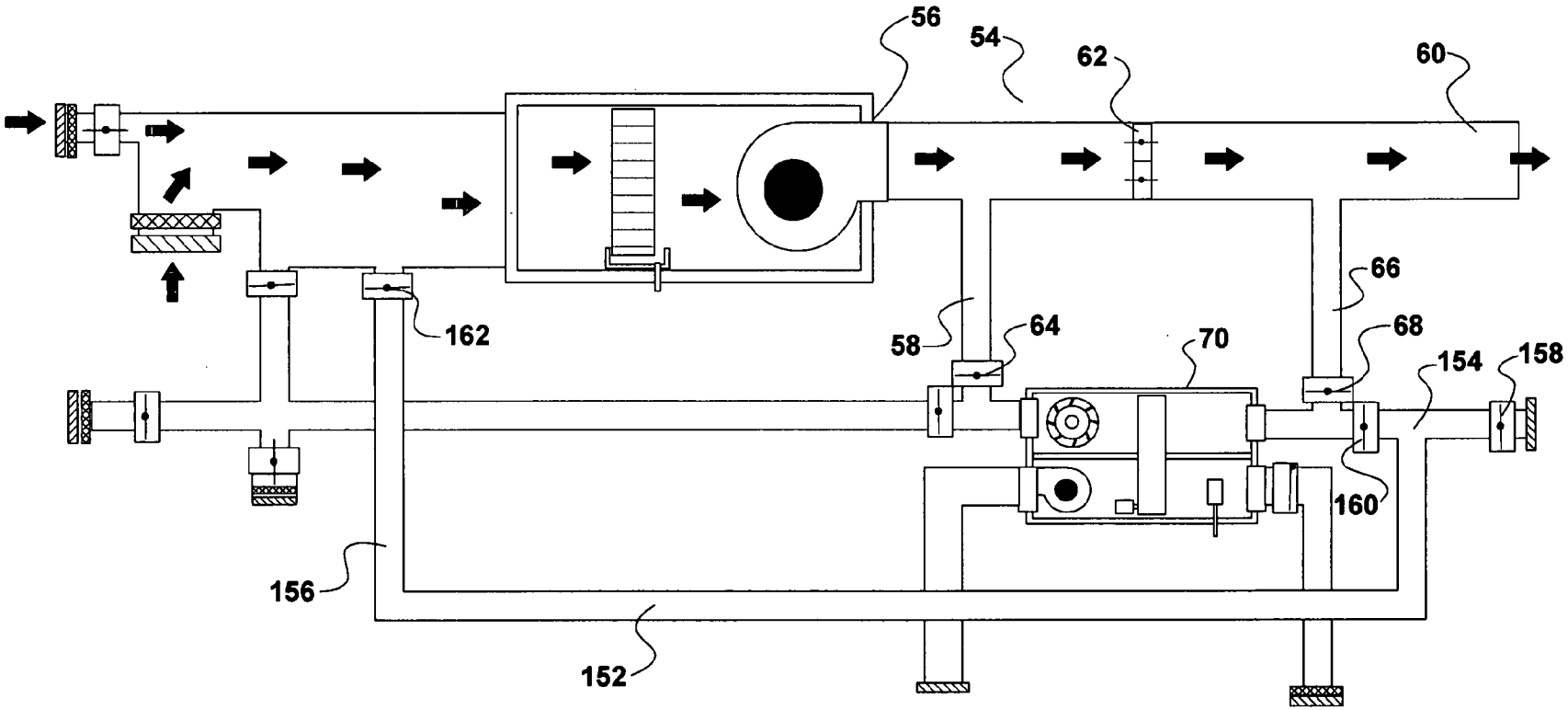
FIG. 2 is a side elevation cross sectional view of the system showing the flow of air when in a Flush-Filtering mode.
Figure 3:
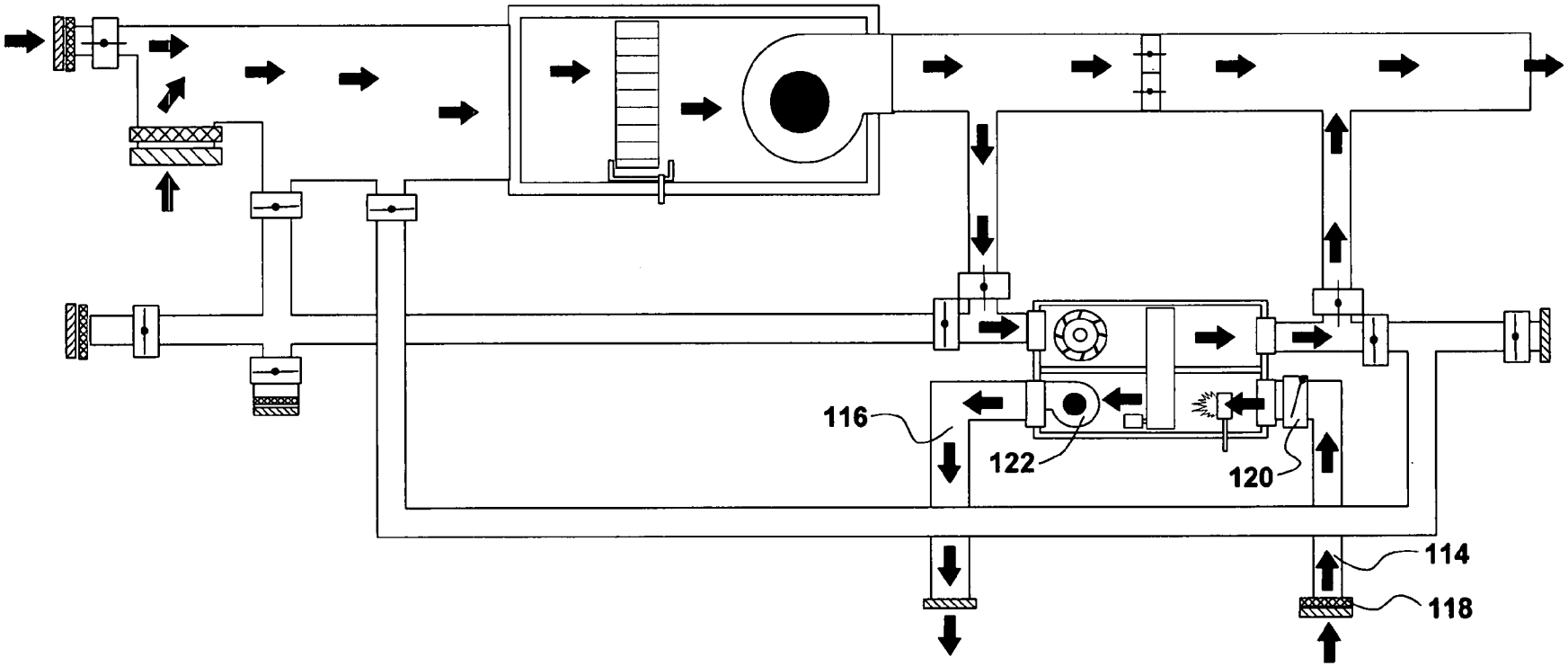
FIG. 3 is a side elevation cross sectional view of the system showing the flow of air when in a Supply to Supply mode.
Figure 4:
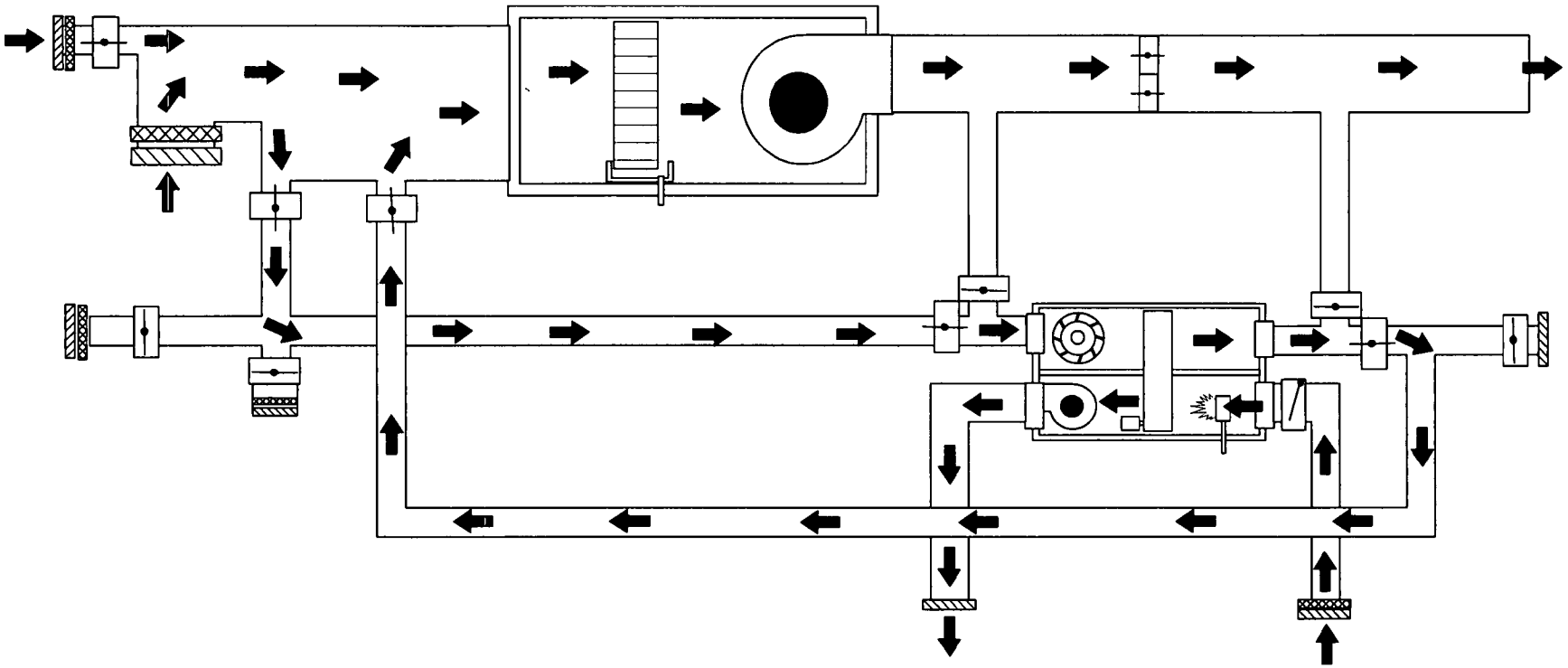
FIG. 4 is a side elevation cross sectional view of the system showing the flow of air when in a Return to Return mode.
Figure 5:
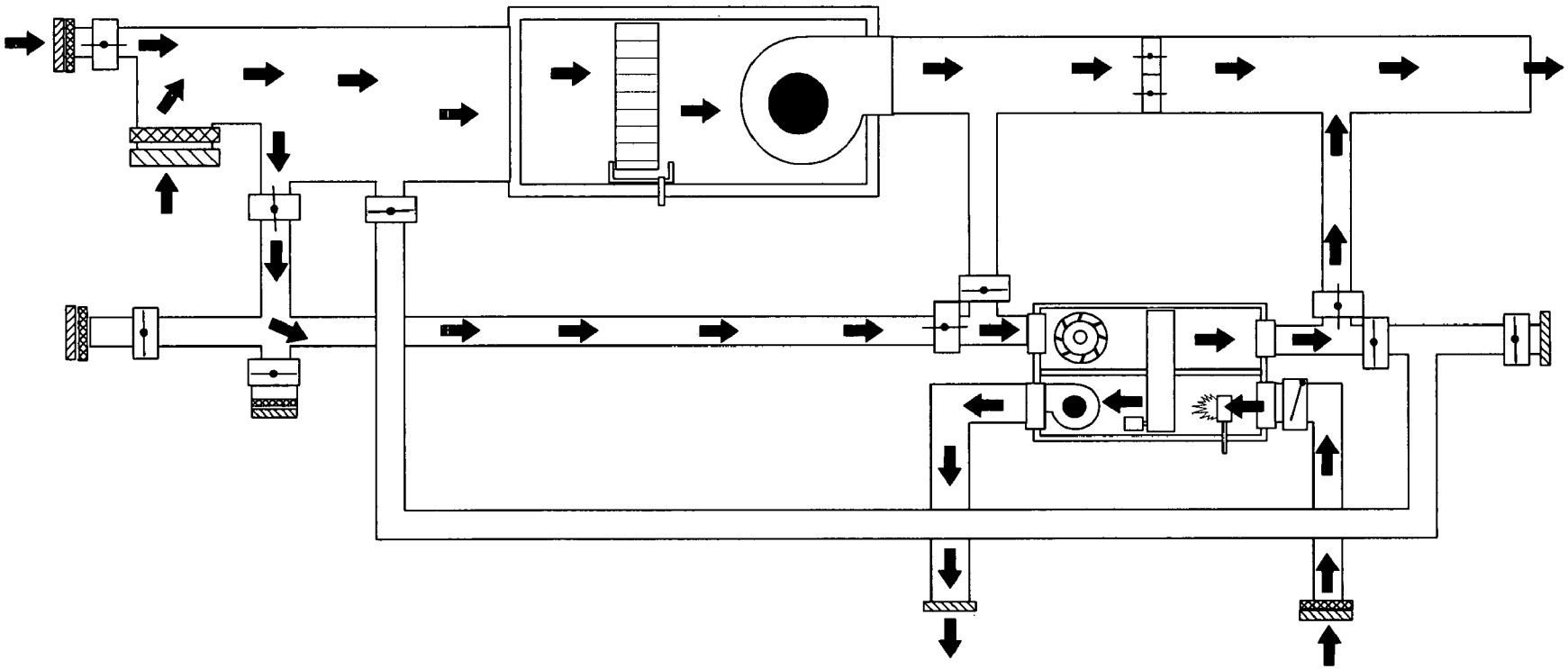
FIG. 5 is a side elevation cross sectional view of the system showing the flow of air when in a Return to Supply mode.
Figure 6:
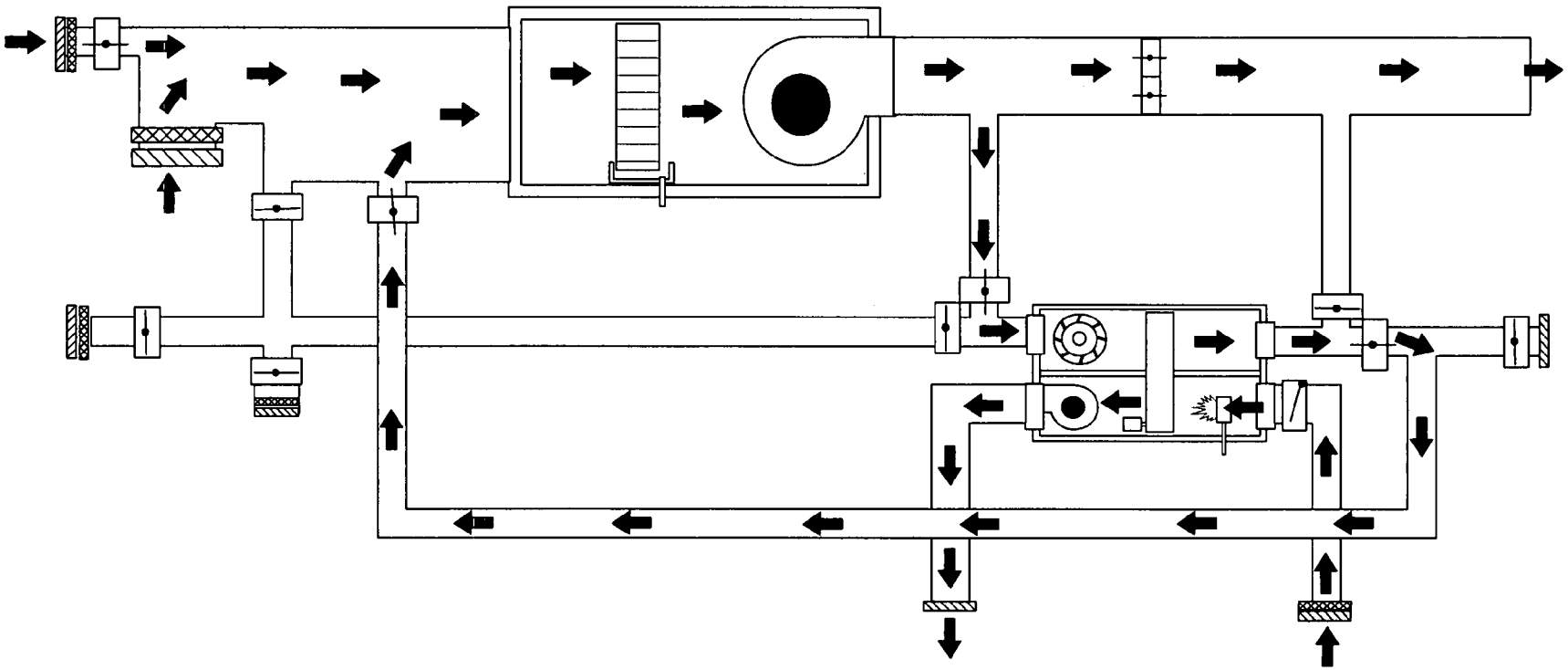
FIG. 6 is a side elevation cross sectional view of the system showing the flow of air when in a Supply to Return mode.
Figure 7:
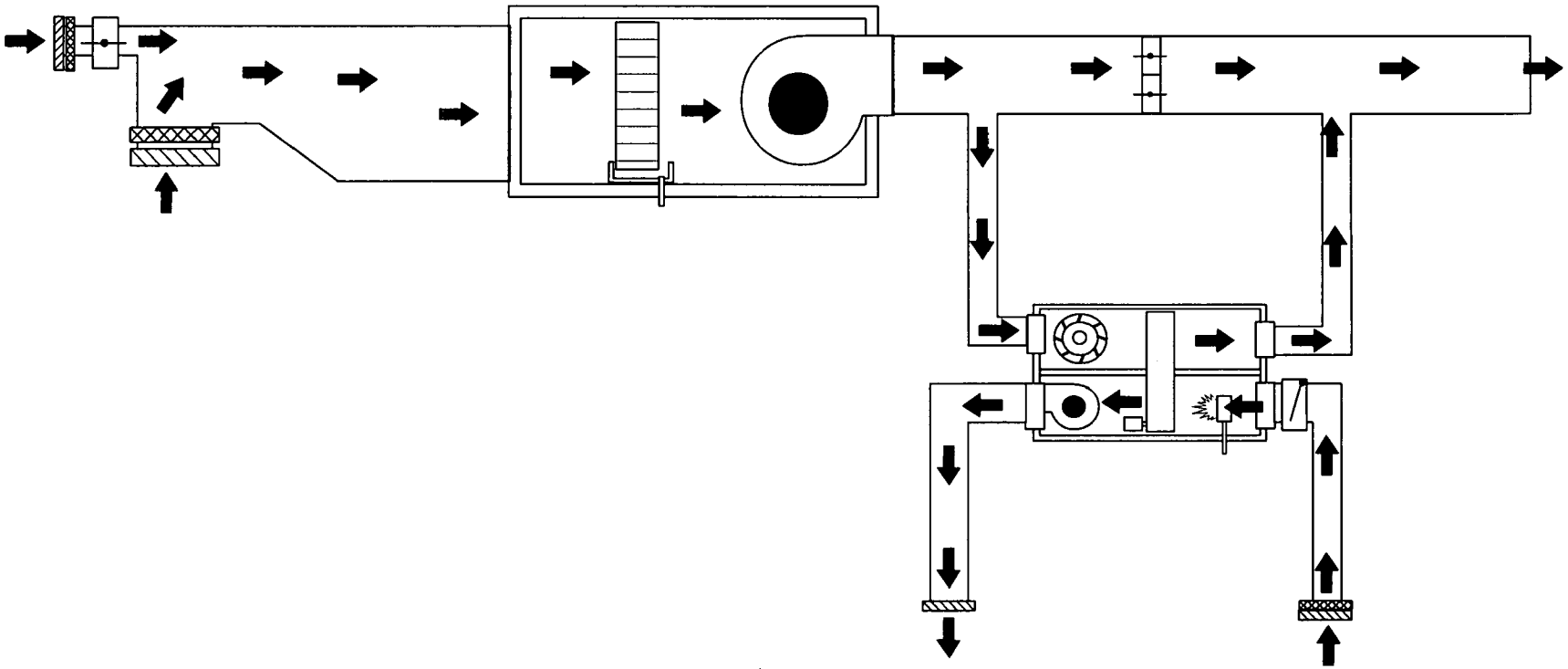
Figure 8:
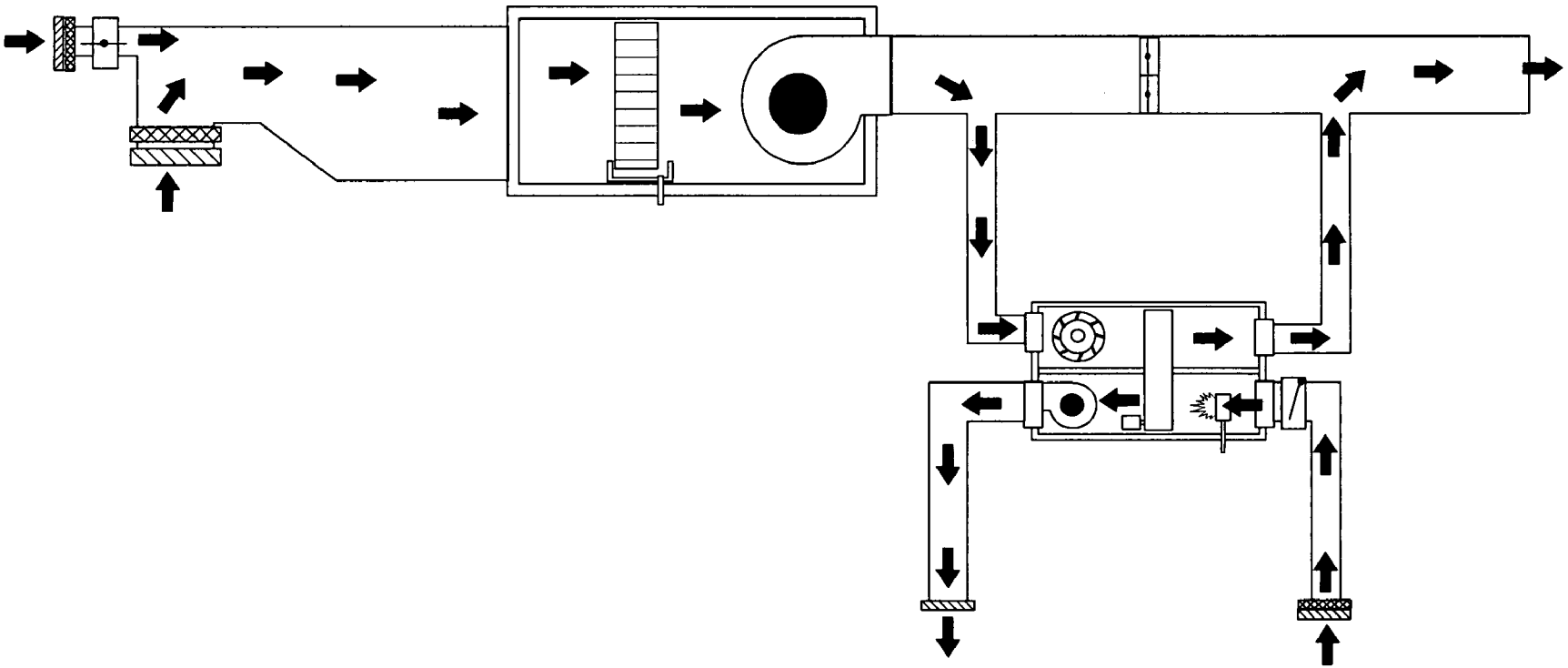
FIG. 8 is a side elevation cross sectional view of the system with the bypass duct eliminated, showing the flow of air when in a Supply to Supply mode with air handler off.
Figure 9:
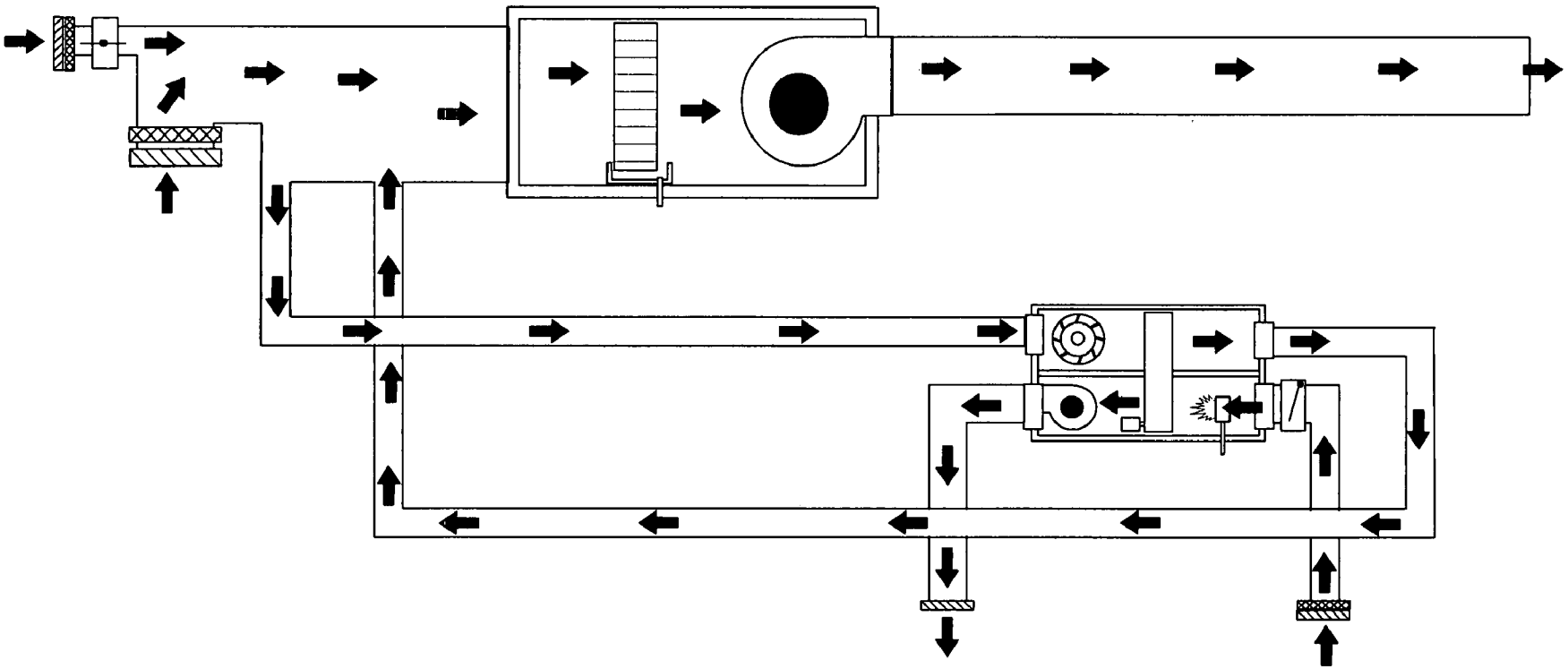
FIG. 9 is a side elevation cross sectional view of the system showing the flow of air when in a Return to Return mode.
Figure 10:
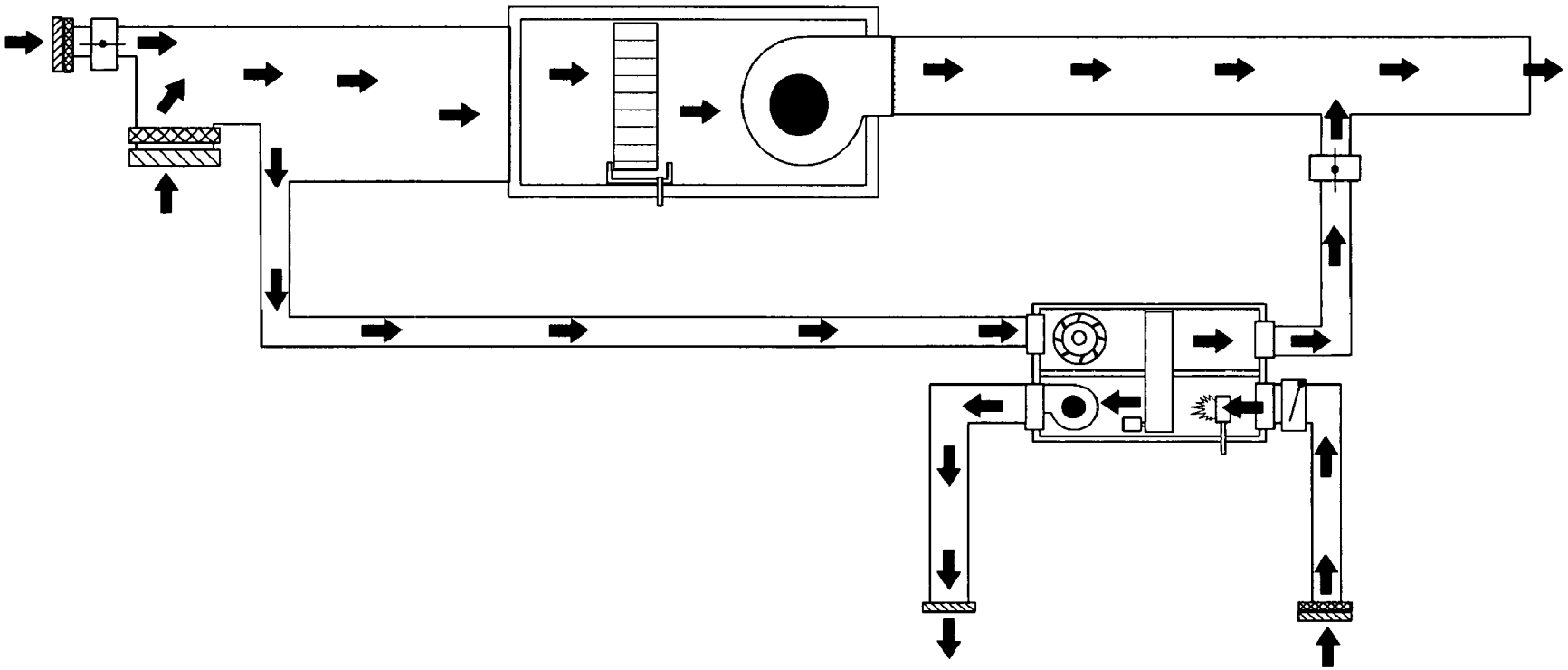
FIG. 10 is a side elevation cross sectional view of the system showing the flow of air when in a Return to Supply pressurized mode.
Figure 11:
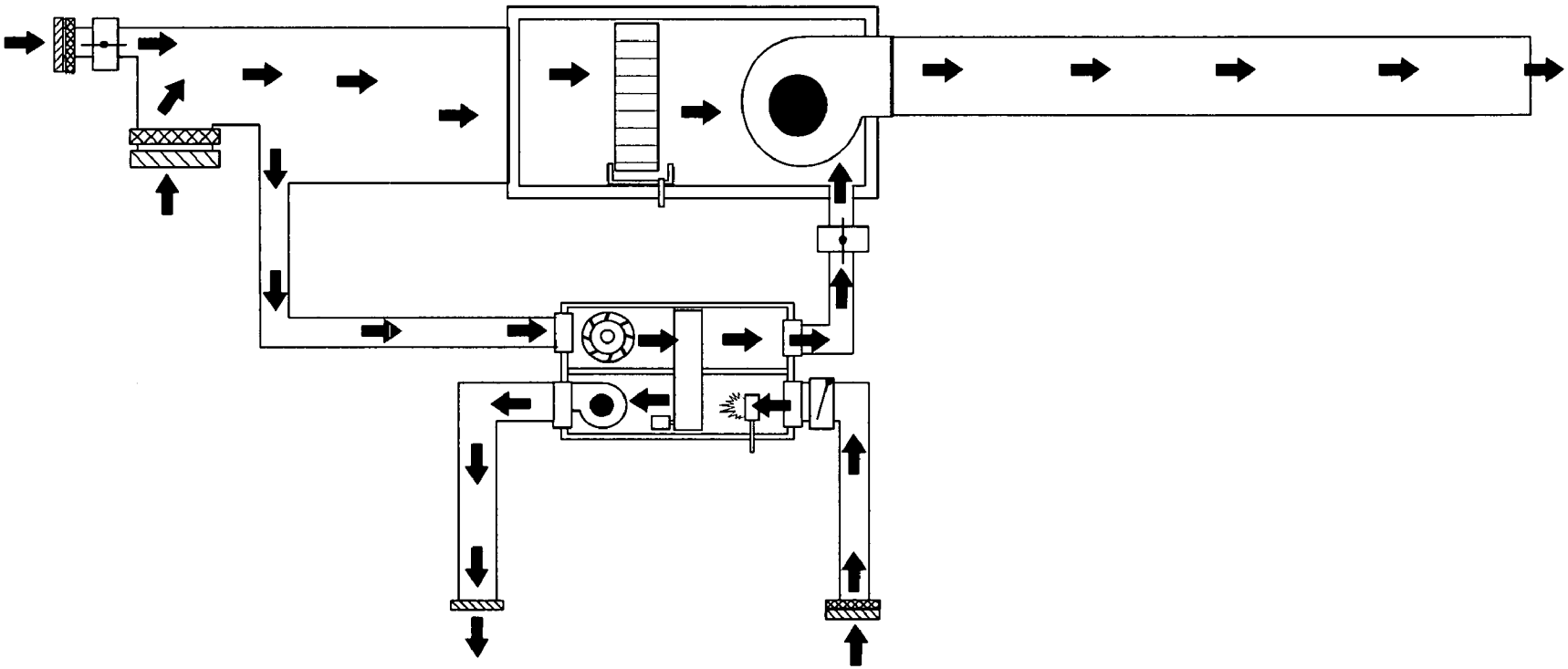
FIG. 11 is a side elevation cross sectional view of the system showing the flow of air when in a Return to Supply negatively pressurized mode.
Figure 12:
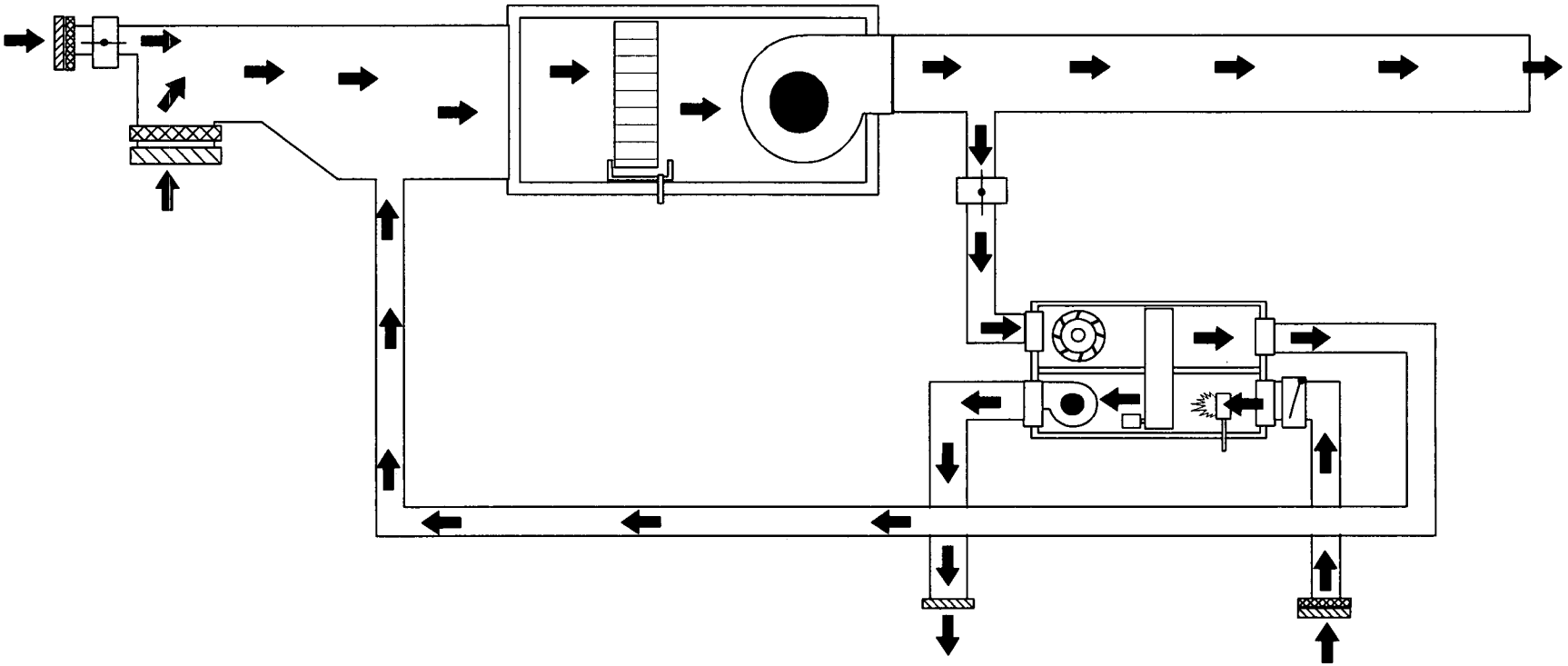
FIG. 12 is a side elevation cross sectional view of the system showing the flow of air when in a Supply to Return mode.
Figure 13:
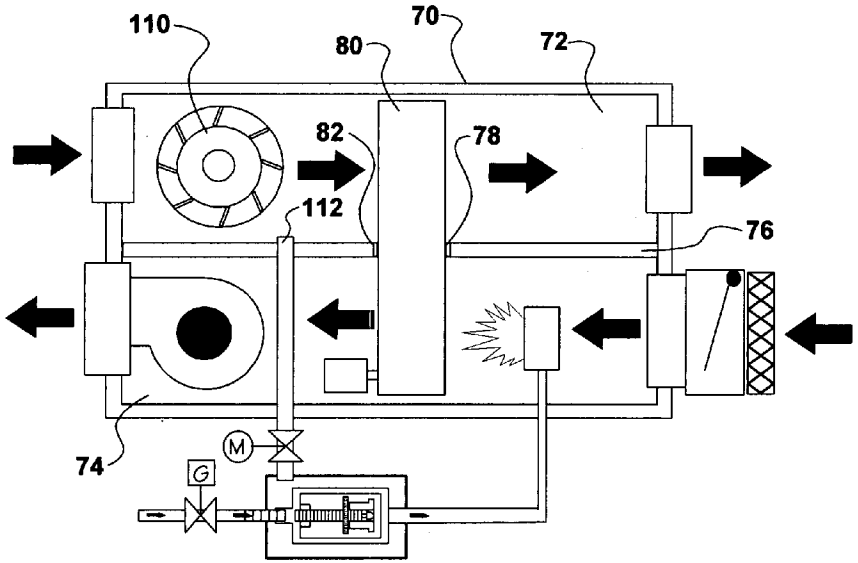
FIG. 13 is a side elevation cross sectional view of the Desiccant unit with the pressure pipe coupled with the processing chamber.
Figure 14:
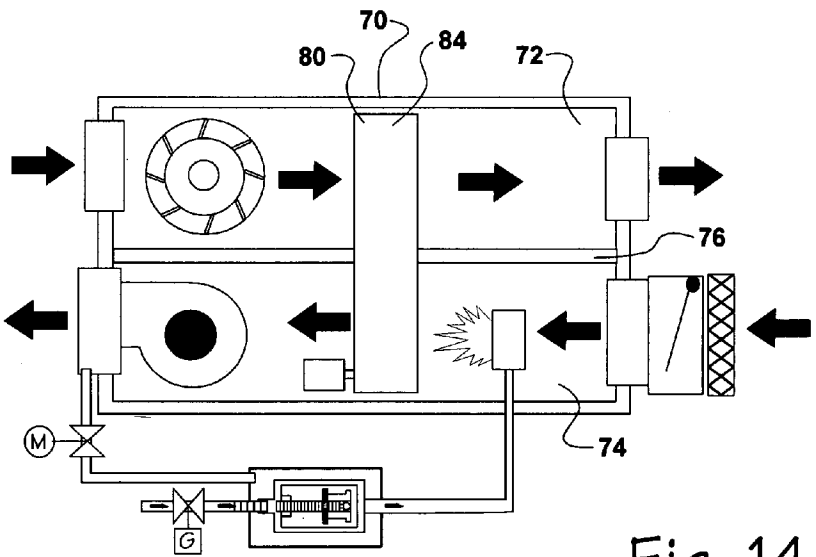
FIG. 14 is a side elevation cross sectional view of the Desiccant unit with the air pressure pipe coupled with the regeneration chamber blower.
Figure 15:
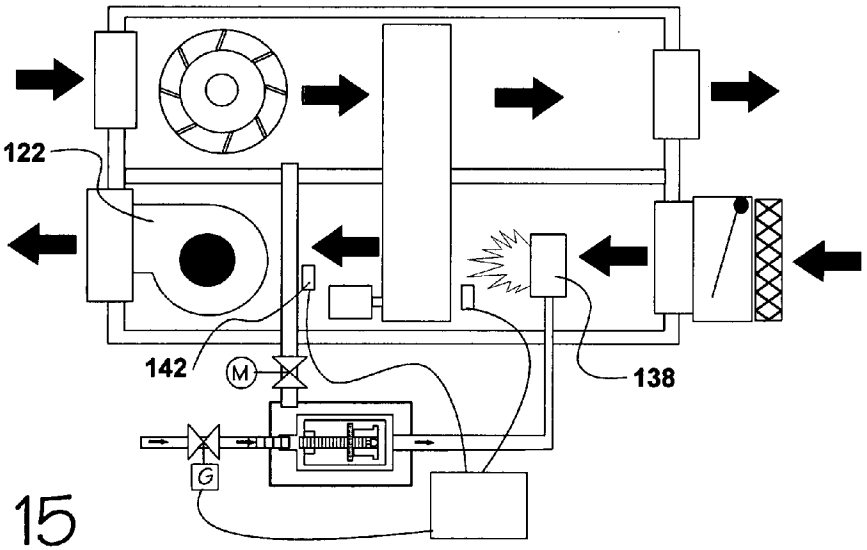
FIG. 15 is a side elevation cross sectional view of the Desiccant unit showing the inclusion of temperature sensors within the regeneration chamber with the air pressure pipe coupled to the process chamber.
Figure 16:
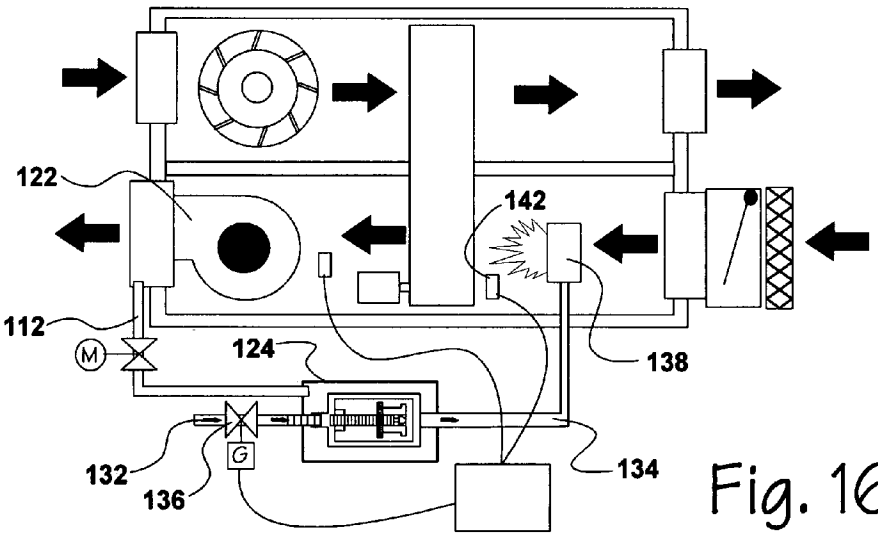
FIG. 16 is a side elevation cross sectional view of the Desiccant unit showing the inclusion of temperature sensors within the regeneration chamber with the air pressure pipe coupled to the regeneration chamber blower.
Figure 17:
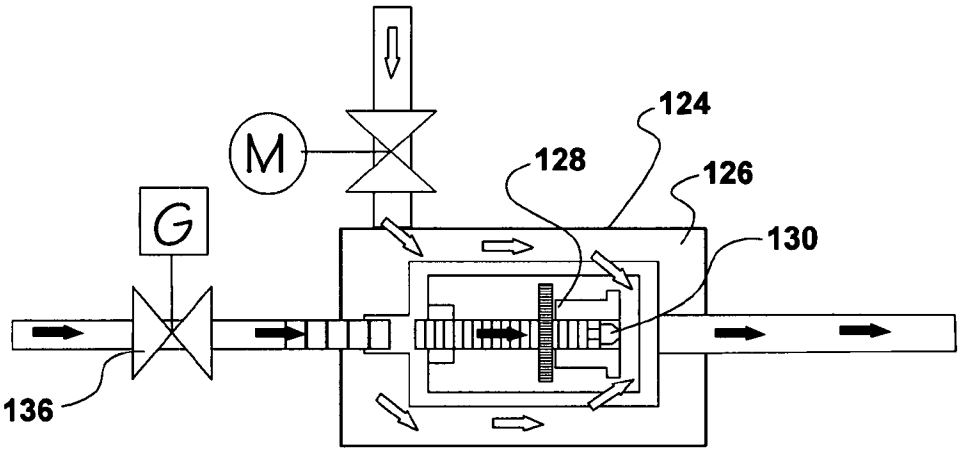
FIG. 17 is a side elevation cross sectional schematic view of the Desiccant unit adjustable gas valve showing the air and gas flow into the mixing chamber.
Figure 18:
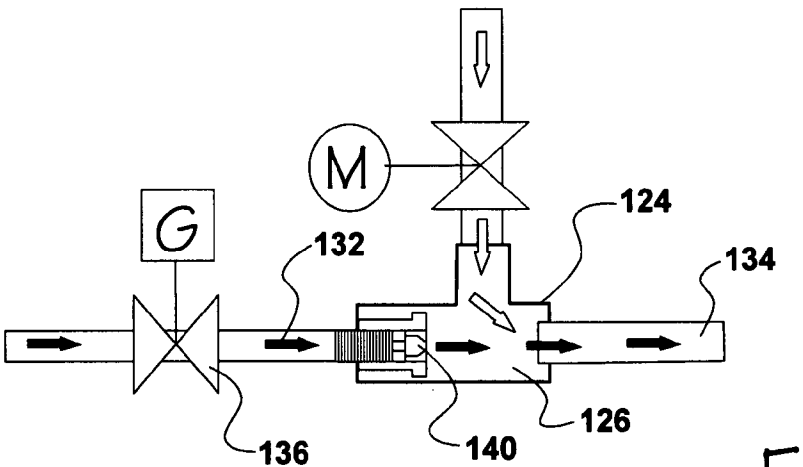
FIG. 18 is a side elevation cross sectional schematic view of the Desiccant unit non-adjustable nozzle showing the air and gas flow into the mixing chamber.
Figure 19A:
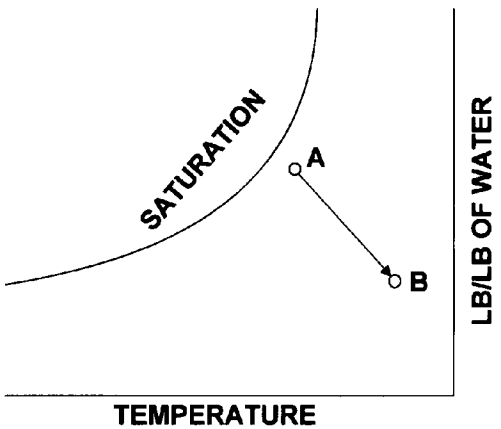
FIG. 19*a* is a graph showing the temperature and humidity relative to the processing chamber operation of the wheel as described in FIGS. 19 and 20.
Figure 19B:
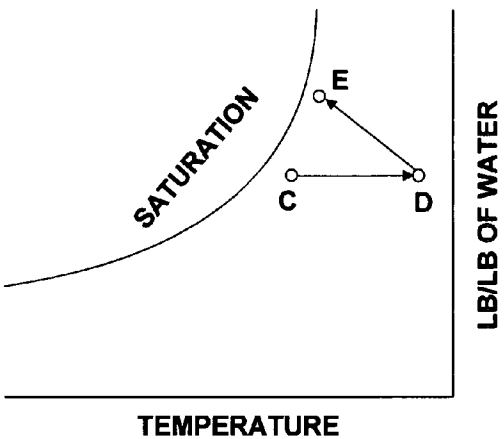
FIG. 19*b* is a graph showing the temperature and humidity relative to the process air operation of the wheel in the regeneration chamber as described in FIGS. 19 and 20.
Figure 19:
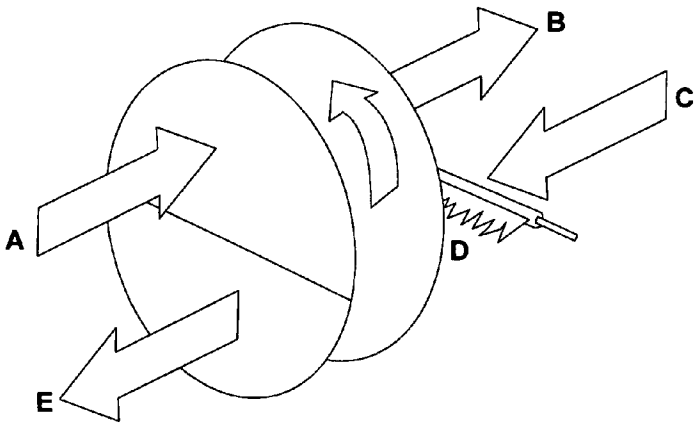
FIG. 19 is a perspective view of the wheel of the Desiccant unit showing the direction of air movement relative to the movement of the wheel as it turns, noting that the wheel surface is divided equally between the two chambers.
Figure 20:
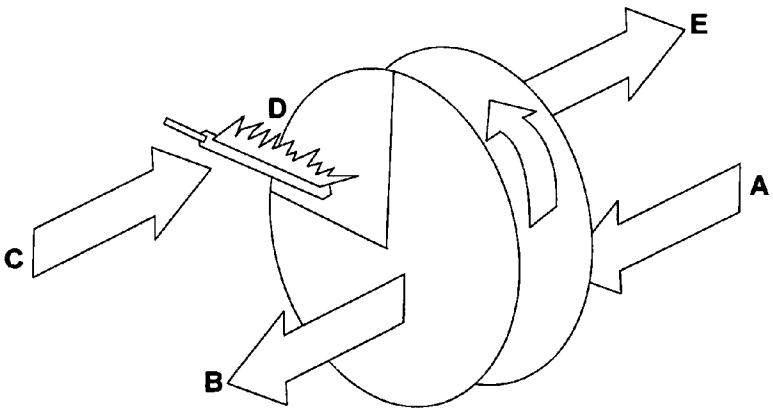
FIG. 20 is a perspective view of the wheel of the Desiccant unit showing the direction of air movement relative to the movement of the wheel as it turns, noting that the wheel surface is divided unequally between the two chambers.
Figure 21A:
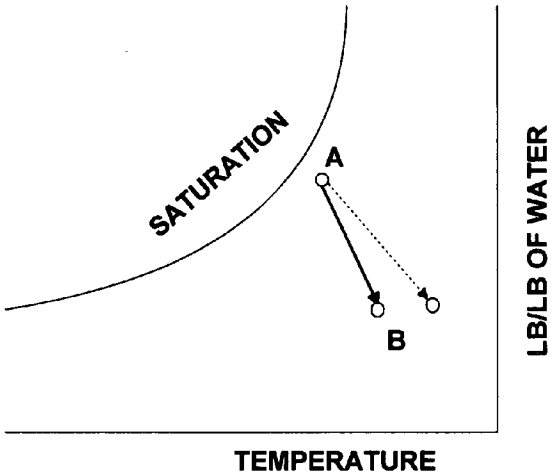
FIG. 21*a* is a graph showing the process chamber air relative to the operation of the wheel as described in FIG. 21.
Figure 21B:
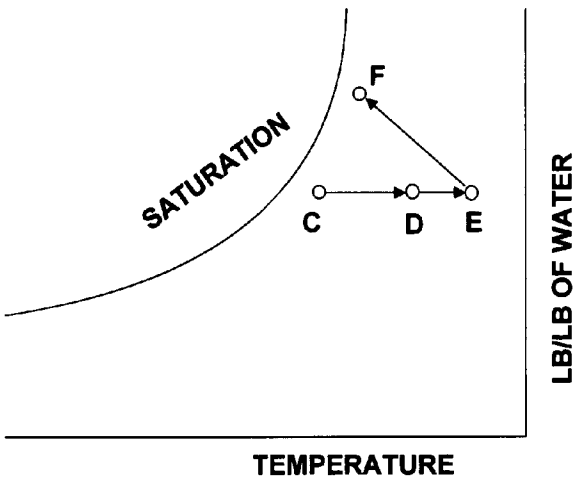
FIG. 21*b* is a graph showing the temperature and humidity relative to the regeneration operation of the wheel as described in FIG. 21.
Figure 21:
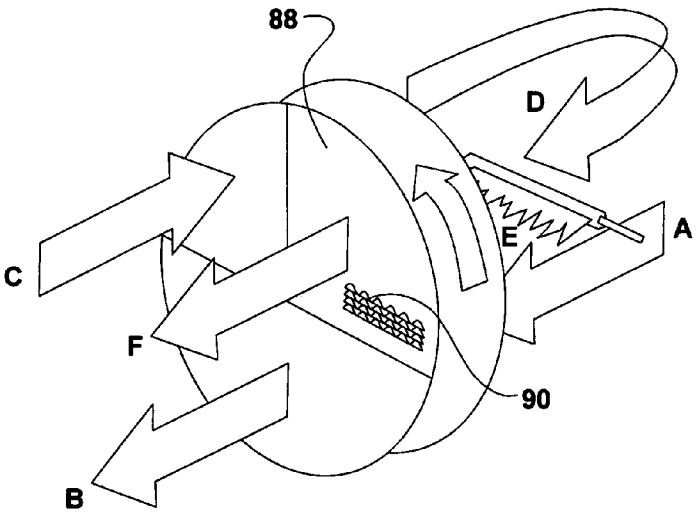
FIG. 21 is a perspective view of the wheel of the Desiccant unit showing the direction of air movement relative to the movement of the wheel as it turns, noting that the wheel surface is divided unequally between the two chambers where the regeneration gases cross the wheel twice.
Figure 22:
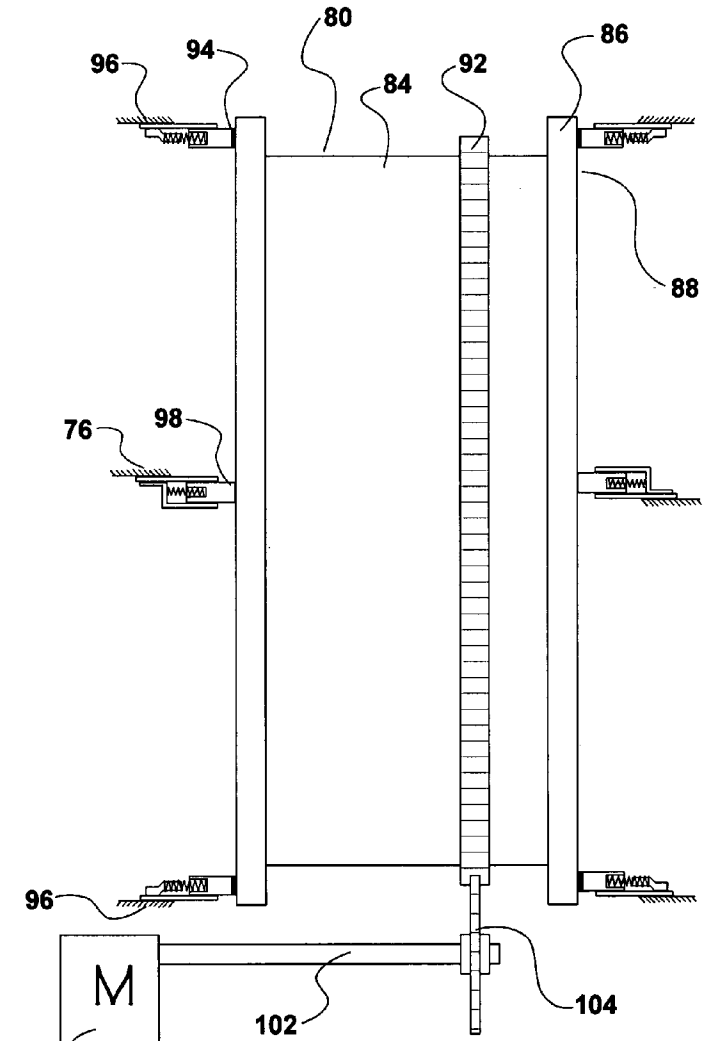
FIG. 22 is a elevation cross section view of the wheel of the Desiccant unit showing the link chain coupled to the drum and the positioning of the seal mounts against the flanges.
Figure 22A:
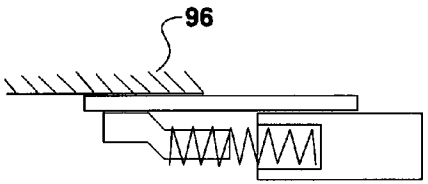
FIG. 22*a* is a cross section view of the desiccant wheel seal seating mounts showing the spring coupled within the recess.
Figure 22B:
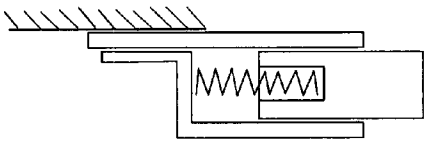
FIG. 22*b* is a cross section view of the desiccant wheel seal seating mounts which couple to the faces of the wheel.
Figure 22C:
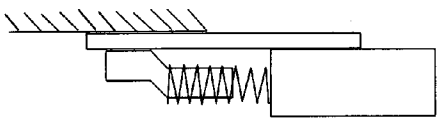
FIG. 22*c* is a cross section view of the desiccant wheel seal seating mounts showing the spring coupled to the recess.
Figure 23:
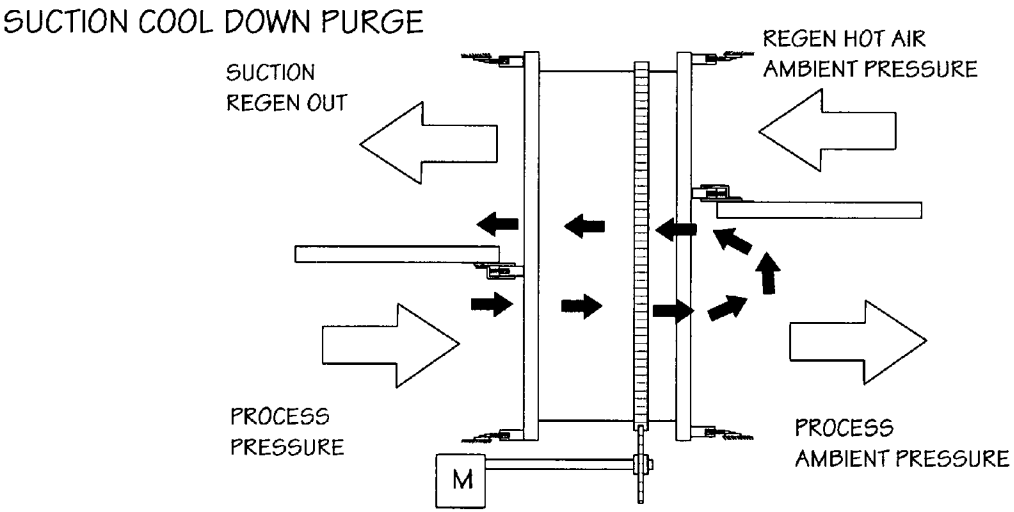
FIG. 23 is a side elevation view of the desiccant wheel showing the flow of air through the wheel, noting that the air is moving from the process chamber through the wheel to the process chamber and then back through the wheel to the regeneration chamber referred to as the "suction cool down purge".
Figure 24:
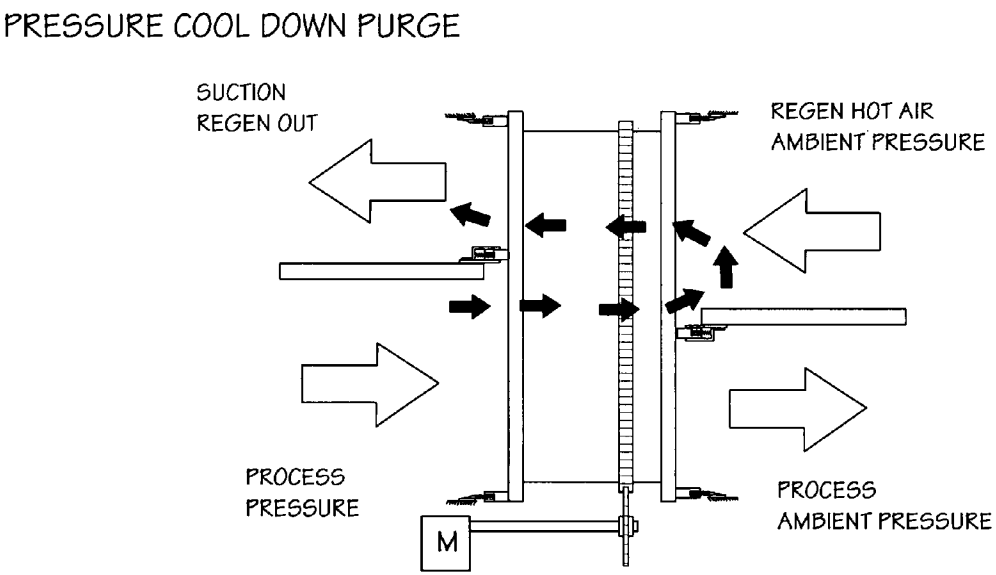
FIG. 24 is a side elevation view of the desiccant wheel showing the flow of air through the wheel, noting that the air is moving from the process chamber through the wheel to the regeneration chamber and then back through the wheel to the regeneration chamber referred to as the "pressure cool down purge".
Figure 25:
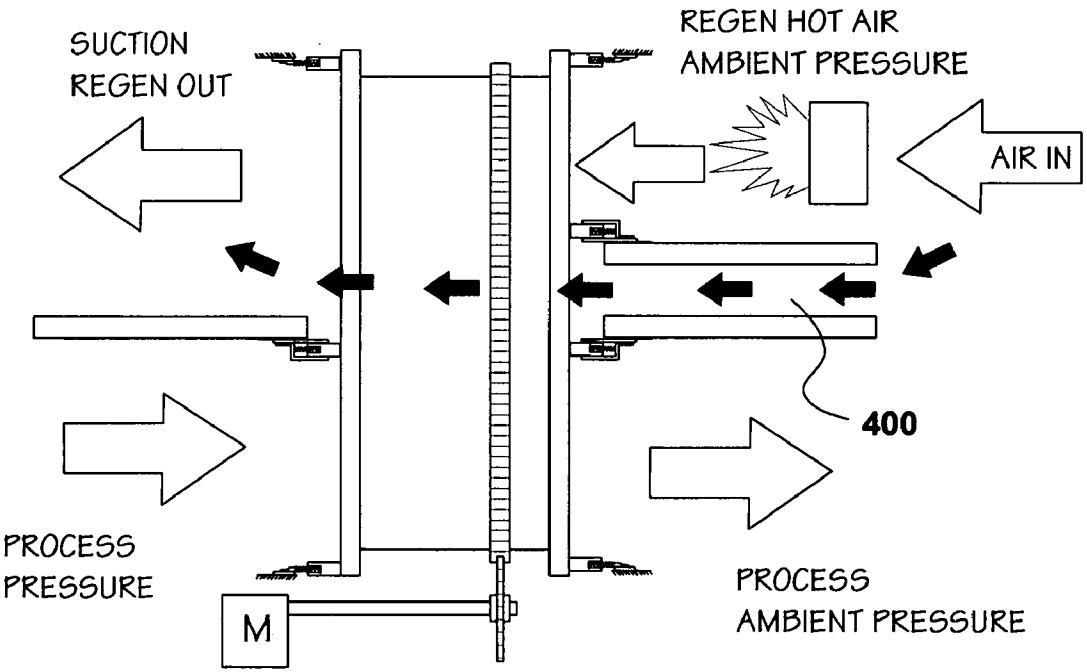
FIG. 25 is a side elevation view of the desiccant wheel showing the flow of air through the wheel, noting that the air is moving, bypassing the burner, through the wheel to the regeneration chamber referred to as the "burner by-pass cool down purge".

With reference now to the drawings, and in particular to FIG. 1 thereof, the preferred embodiment of the new and improved desiccant dehumidification and temperature control system embodying the principles and concepts of the present invention and generally designated by the reference numeral 10 will be described.

The present invention, the desiccant dehumidification and temperature control system 10 is comprised of a plurality of components. Such components in their broadest context include a space, an air handler, an inflow manifold, an outflow manifold, a desiccant unit and a plurality of ducts. Such components are individually configured and correlated with respect to each other so as to attain the desired objective.

The primary embodiment of the invention is shown in FIGS. 1 through 6. These Figures show the primary embodiment with its various components at various settings for various applications. FIGS. 7 through 18 show similar embodiments but with various components removed thereby resulting in greater economy but with lesser flexibility. FIGS. 19 through 27 illustrate alternate embodiments of the invention.

A desiccant dehumidification and temperature regulation system 10 for allowing a user to conveniently and efficiently control temperature and humidity levels of a space. The system comprises several components in combination.

First provided is a space 12 to have air humidity and temperature regulated independently. Next provided is an air handler 14. The air handler has a temperature regulation element 16 and a fan 18 and a housing 20. The element and the fan are contained within the housing. The housing has an inflow opening 22 and an outflow opening 24.

Next provided is an inflow manifold 26. The inflow manifold has a generally hollow configuration for allowing the passage of gases there through. The manifold has an intake end 28 and an outflow end 30. There is an ambient air intake stub 32 located at the outermost end of the intake end. The ambient air intake stub has a outermost grill 34 and a filter 36 and an innermost damper 38. The damper is mechanically controlled by a sensing device motor, actuator or airflow.

The intake end of the manifold also has a return air stub 40. The return air stub has an outer grill 42 and an inner filter 44. The intake end of the manifold has a desiccant inflow connection stub 46 with a mechanically controlled damper 48. The intake end of the manifold also has a desiccant bypass inflow connection stub 50 with a mechanically controlled damper 52. The inflow manifold is coupled with the air handler.

Next provided is an outflow manifold 54 having a generally hollow configuration for allowing the passage of gases there through. The outflow manifold has an intake end 56 that is coupled to the air handler. There is a desiccant supply stub 58 located on the intake end. The outflow end has a stub 60 with the outflow end being coupled to the interior of a space. There is a mechanically controlled damper 62 located within the outflow manifold to provided air flow control through that manifold.

The outflow manifold has a desiccant supply stub 58 that has a mechanically controlled damper 64 located near the air handler. There is a desiccant return stub 66 that has a mechanically controlled damper 68. The stub is located between the damper and the interior of a room.

Next provided is a desiccant unit 70 having a housing with an upper processing chamber 72 and a parallel lower regeneration chamber 74. Each chamber is separated from the other chamber by an interior wall 76. The interior wall has a wheel aperture there through 78. The unit has a desiccant wheel 80 coupled to an axle 82. The axle is coupled to the interior wall to position the wheel within each of the chambers and to allow for the rotation of the wheel.

The wheel has a drum portion 84 and a pair of outermost flanges 86 and two flat parallel faces 88 forming a thickness there between. There is a plurality of desiccant coated air passageways 90 located perpendicular to the flat faces that form a plurality of passageways through the thickness of the wheel. The passageways allow the passage of gases there through.

The wheel drum has a linked chain 92 coupled there to. The wheel also has a round ring seal 94 to seal off each of the chambers from the other. Each chamber has a plurality of wheel seal mounting portions 96. Each mounting portion has a plurality of spring mounted seats.

The interior wall has a plurality of surface seals 98 to contact the wheel face to provide a seal between the chambers. The unit has an electro-mechanical motor 100 and a motor axle 102 and a sprocket 104 sized to mate with the linked chain to provide a means for turning the wheel about the wheel axle.

The upper processing chamber has a Y-shaped inflow stub 106 and a Y-shaped outflow stub 108. One branch of the Y-shaped inflow stub couples to the intake end stub of the outflow manifold and the other branch of the Y-shaped inflow stub couples with the desiccant inflow connection stub. One branch of the Y-shaped outflow stub is coupled to the outflow end of the outflow manifold.

The wheel is located at about the midpoint of the chamber. An electro-mechanical blower 110 located between the wheel and the inflow stub. There is a gas pressurizing aperture 112 into the upper chamber which allows the delivery of pressurized air into a pipe.

In an alternative configuration, the air is passed through the wheel in the regeneration chamber and then back through the wheel in the regeneration chamber, thereby preheating the air to maximize the regenerating effect of the heated air reducing the energy consumption of the burner.

In an alternative configuration of this configuration, the regeneration of air is recycled through the wheel thereby increasing the efficiency of the burner.

The desiccant unit configuration may be altered by moving the location of the interior wall, or making a passage or utilizing a pipe 400 so as to allow the movement of air from the processing chamber into the regeneration chamber or to allow the introduction air into the regeneration chamber and bypassing the heating source cooling the wheel before rotate to the process side.

The lower regeneration chamber has an inflow stub 114 coupled to a duct that communicates with an air source. The lower chamber has an outflow stub 116 that communicates with outside of the space exhausting regeneration gases. The inflow stub has a filter 118 and a gravity damper 120 located there at. The regeneration blower 122 is located near the outflow stub.

In an alternative embodiment, the gas pressurizing aperture 112 is into the blower 122 located in the lower regeneration chamber.

The unit has a gas valve assembly 124. The assembly has a pressurized mixing chamber 126. There is a pressurized air pipe coupled from the blower 122 chamber and to the body of the mixing chamber 126 that allows the introduction of pressurized air into the mixing chamber. There is a threadedly adjustable gas valve 128 with a gas nozzle 130 located within the pressurized mixing chamber.

There is an associated gas inflow pipe 132 and a gas outflow pipe 134. The gas inflow pipe is coupled to an existing gas supply with the inflow pipe also coupled to a line gas valve 136. The gas inflow pipe also couples the gas line valve and the pressurized mixing chamber 126. The gas inflow pipe enters the mixing chamber and therein couples with the nozzled adjustable gas valve. A gas outflow pipe 134 is coupled to the mixing chamber and passes into the regeneration chamber of the unit. The gas outflow pipe terminates with a gas burner 138. The gas burner provides a source of heat to the gasses that pass through the wheel. The resultant heating thereby regenerates the desiccant located on the surfaces of the wheel.

In an alternative configuration the mixing chamber has a non-adjustable gas nozzle 140, but can vary the orifice size.

In an alternative configuration, there are a plurality of sensors 142 located within the lower, regeneration chamber. The sensors are coupled electronically to a controlling device which in turn adjusts the amount of gas to flow through the gas pipe, and thereby controls the heat delivered to the regeneration chamber.

In an alternative configuration, there is a compressor 144, a boost heater 410, and an evaporator 146 and a condenser 148 and a plurality of heat pipes 150 used in association with the desiccating unit.

Lastly provided is a bypass duct 152 having a hollow tubular configuration. The duct has an inflow end 154 and an outflow end 156. The inflow end has T-shaped end with one side of the T-shaped end having a mechanically controlled damper 158 and couples with a space. The other side of the T-shaped end has a mechanically controlled damper 160 and couples to the outflow stub of the processing chamber of the desiccant unit. The bypass duct runs to and couples to the intake manifold at the outflow end of the duct. The outflow end of the duct has a mechanically controlled damper 162 coupled there to.

The system comprises a plurality of dampers which allow the system to function in a plurality of modes, such as the flush-filtering mode, the supply to supply mode, the return to supply mode, the return to return mode, and the supply to return mode. The dampers allow the system to move air through the desiccator unit as it moves toward the living space, such as in the supply to supply mode.

In an alternate embodiment, the blower of the desiccator may move the air, without the air handler being in the operation mode, such operation being included in the supply to supply mode. The dampers allow the system to move air through the desiccator unit back into the intake manifold and into the air handler, such as in the return to return mode.

Alternatively the dampers allow the movement of air through the desiccator unit and into the outflow manifold, bypassing the air handler, as in the return to supply mode of operation. In this mode the air returning to the outflow manifold is under the pressure of the processing chamber blower.

In an alternative embodiment, there is a return duct from the processing chamber directly into the air handler. In this mode of operation, the negative pressure generated within the air handler by the blower draws the air through the processing chamber of the desiccating unit. The ducts and dampers also allow the movement of air through the processing chamber of the desiccating unit back into the intake manifold, described as a supply to return mode of operation.

Figure 26:
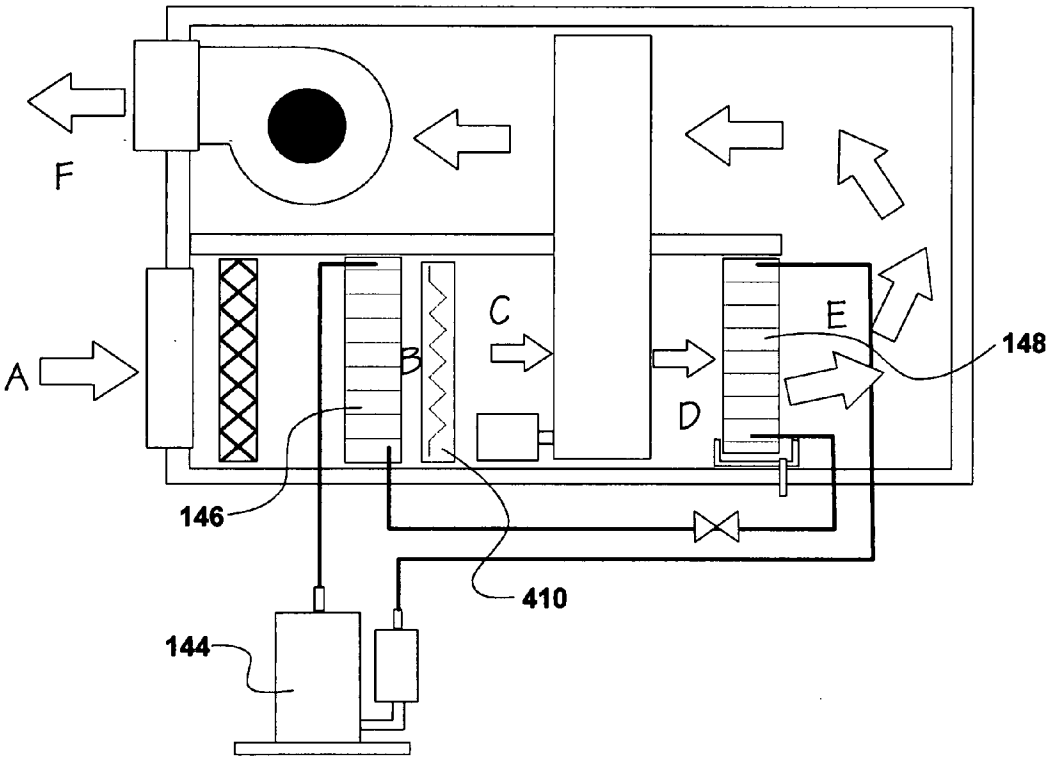
FIG. 26 is a side elevation cross sectional view of the desiccant wheel showing an associated compressor and condenser and evaporator having one air path with process and supply in tandem.
Figure 26A:
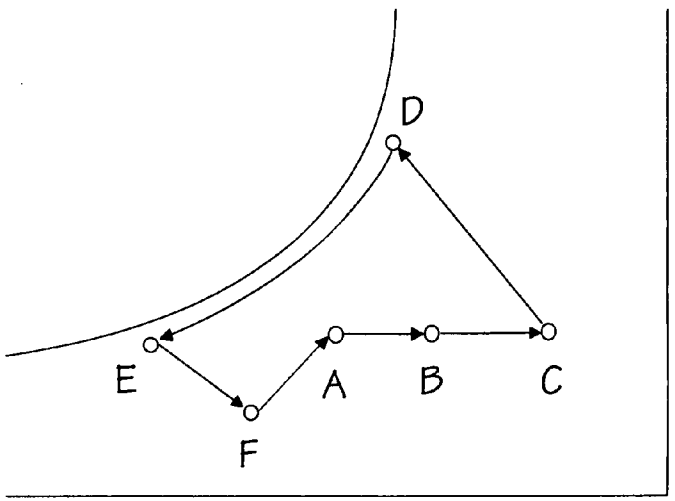
FIG. 26*a* is a graph showing the temperature and humidity relationship generated by the process chamber and regeneration chamber acting single pathway in the desiccant wheel of FIG. 26.

With reference to FIGS. 26 and 26*a*, in the space/room "A", the air crosses the filter and condenser section leading to section "B" where the air is hot. If "B" cannot supply the necessary temperature, the booster heater will raise the temperature to the "C" condition, from "A" to "C". The temperature is raised but the content of water is constant. The air flow crosses the desiccant wheel leading to "D". Now the air is cool and very saturated of humidity that the wheel is giving. At this point, the air will be close to saturation. Air flow continuing across the evaporator is very cool and is condensing whereby liquid is disposed out of the system into the condensate pan outlet. Much of the content of water is remover from the air. The temperature is at "E", where the air is still close to saturation, but with a lower content of water. The air flow across the drying section of the desiccant wheel reduces the content of water lower but raises the temperature leaving at "F". This is a characteristic of the desiccant materials. The air at "F" will be pulled by the blower to the space/room for conditioning. From "F" to "A" will be the heat and humidity gain that the space is generating for a thermal load of humidity gain.

Figure 27:
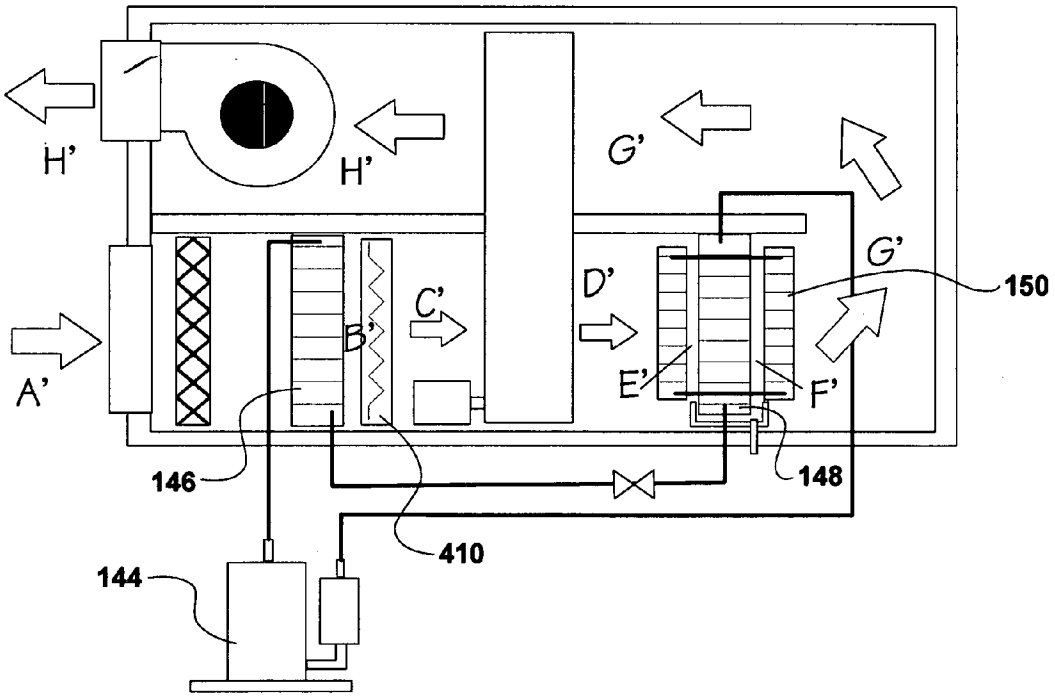
FIG. 27 is a side elevation cross sectional view of the Desiccant unit showing an associated compressor and condenser and evaporator and heat pipes.
Figure 27A:
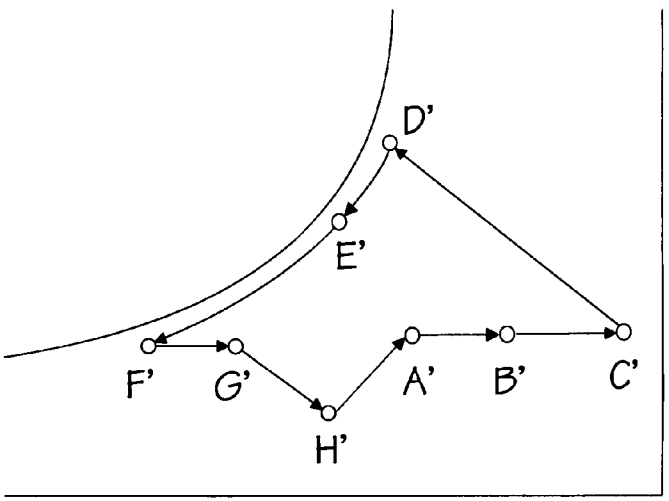
FIG. 27*a* is a graph showing the temperature and humidity relationship generated by the Desiccant unit of FIG. 27 with the processing and regeneration chambers acting as one pathway.

In FIGS. 27 and 27*a*, the arrangement is very similar to that of FIGS. 26 and 26*a* discussed above. The only difference is the addition of heat pipes as heat exchangers for precooling and reheating the air. This is for increasing the dehumidification capacity. The space/room "A" air crosses filter and condenser section leading to "B". Here the air is hot. If "B" cannot supply the necessary temperature, the booster heater will raise the temperature to "C" condition. From "A" to "C", the temperature is raised but the content of water is constant. The air flow across the desiccant wheel leads to "D". Now the air is cool and very saturated of humidity that the wheel is giving. At this point the air will be close to saturation. Air flows across the percooling section of the heat pipe, cooling the air and staring to condense water, leading to "E" condition. Later the air will go to the evaporator, very cool, condensing more water from the last two stages which is disposed out the system into the condensate pan outlet. At section "F", the air is still close to saturation but with a lower contain of water. The air continues traveling across the second heat pipe, called reheat section. Air leaves at section "G" keeping the same content of water as at point "F", but warming the air closer to comfort conditions. The air flow crosses the drying section of the desiccant wheel thereby reducing the content of water lower but raising the temperature leaving at "H". This is a characteristic of the desiccant materials. The air at section "H" will be pulled by the blower into the space/room conditioned for comfort. From "H" to "A" there will be a heat and humidity gain that the space/room is generating from the thermal load of the humidity gain.

The present invention is an integrated group of devices that allow control of humidity and temperature independently and on demand, without the overcooling of traditional and conventional methods. This equipment permits the use of desiccant technology totally independent or associated with existing HVAC systems. To achieve comfort in humidity does not require overcooling the space. At the same time, levels of humidity lower than the conventional existing system under the HVAC dew point with lower cost of energy can be achieved. The invention permits keeping building spaces at positive pressurization and complying with the requirements of building codes for fresh air induction. The invention allows treatment of the outside air inducted to the space as well as the indoor air to achieve the desired comfort parameters.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An advanced control of humidity and temperature system for allowing a user to conveniently and efficiently and independently control temperature and humidity levels of a space comprising, in combination:

a space to have air humidity and temperature regulated;

an air handler having a temperature regulation element and a fan and a housing with the element and the fan being contained with the housing, with the housing having an inflow opening and an outflow opening;

an inflow manifold having a generally hollow configuration for allowing the passage of gases there through with the manifold having an intake end and an outflow end being coupled to the air handler, with an ambient air intake stub located at the outermost end of the intake end, the ambient air intake stub having a outermost grill and a filter and an innermost damper, the damper being mechanically controlled, the intake end of the manifold also having a return air stub with a outer grill and an inner filter, the intake end of the manifold having a desiccant inflow connection stub with a mechanically controlled damper and a desiccant bypass inflow connection stub with a mechanically controlled damper;

an outflow manifold having a generally hollow configuration for allowing the passage of gases there through with the outflow manifold having an intake end being coupled to the air handler and an outflow end having a stub with the outflow end being coupled to the interior of a room in said space, with a mechanically controlled damper being located within the outflow manifold, the outflow manifold having a desiccant supply stub having a mechanically controlled damper located near the air handler and a desiccant temperature control return stub having a mechanically controlled damper located between the air handler and the interior of a room in said space;

a desiccant unit having a housing with an upper processing chamber and a parallel lower regeneration chamber with each chamber being separated from the other chamber by an interior wall with the interior wall having a wheel aperture there through, with the unit having a desiccant wheel coupled to an axle, with the axle coupled to the interior wall to position the wheel within each of the chambers, the wheel having a drum portion and a pair of outermost flanges and two flat parallel faces forming a thickness there between, with a plurality of desiccant treated air passageways being perpendicular to the flat faces and forming a plurality of passageways through the thickness of the wheel to allow the passage of gases there through, the wheel drum having a linked chain coupled there to, the wheel also having a round ring seal, with each chamber having a plurality of wheel seal mounting portions with each mounting portion having a plurality of spring mounted seats, the interior wall having a plurality of surface seals to contact the wheel face to provide a seal between the chambers, the desiccant unit having an electro-mechanical motor and a motor axle and a sprocket sized to mate with the linked chain to provide a means for turning the wheel about the wheel axle, the upper processing chamber having a Y-shaped inflow stub and a Y-shaped outflow stub with one branch of the Y-shaped inflow stub coupling to the desiccant supply stub of the outflow manifold and the other branch of the Y-shaped inflow stub coupling with the desiccant inflow connection stub, with the desiccant inflow connection stub further having a plurality of dampers and grills and filters, and one branch of the Y-shaped outflow stub being coupled to the desiccant temperature control return stub of the outflow manifold, with the wheel located at about the midpoint of the chamber, with an electro-mechanical blower located between the wheel and the Y-shaped inflow stub with the upper processing chamber having a gas pressurizing aperture connected there into, the lower regeneration chamber having an inflow stub coupled to a duct that communicates with an air source and an outflow stub that communicates with outside of the space to exhaust gases, with the inflow stub having a filter and a gravity damper located there at and the outflow stub having a regeneration blower located there at with the regeneration chamber having a gas mixture tube, the unit having a gas valve assembly, the assembly having a pressurized mixing chamber, a threadedly adjustable gas valve with a gas nozzle being located within the pressurized mixing chamber and a gas inflow pipe and a gas outflow pipe, the gas inflow pipe is coupled to an existing gas supply with the inflow pipe also coupled to a line gas valve with the gas inflow pipe also coupling the gas line valve and the pressurized mixing chamber with the gas inflow pipe entering the mixing chamber and there coupling with the threadedly adjustable gas valve with a gas outflow pipe being coupled to the mixing chamber and passing into the regeneration chamber of the unit and there ending with a gas burner, the gas burner providing a source of heat to the gasses passing through the wheel and thereby regenerating the desiccant located on the surfaces of the wheel;

a bypass duct having a hollow tubular configuration with a inflow end and an outflow end, the inflow end having T-shaped end with one side of the T having a mechanically controlled damper and coupling with a space and the other side of the T having a mechanically controlled damper being coupled to the Y-shaped outflow stub of the processing chamber of the desiccant unit with the bypass duct running to and coupling to the intake manifold at the bypass inflow connection stub.

2. An advanced control of humidity and temperature system for a space to have air humidity and temperature regulated comprising, in combination:

an air handler having an inflow opening and an outflow opening and also having a temperature regulation element and a fan and a housing;

an inflow manifold having an intake end and an outflow end and a plurality of stubs and a plurality of dampers to control the flow of air into and out of the inflow manifold, the outflow end of the inflow manifold coupled to the inflow opening of the air handler;

an outflow manifold having an intake end and an outflow end, the outflow manifold having a plurality of stubs and a plurality of dampers to control the flow of air into and out of the outflow manifold, the inflow end of the outflow manifold coupled to the outflow opening of the air handler;

a desiccant unit having a regeneration chamber with a blower, and a processing chamber with a blower, with the processing chamber having an air supply pipe being pressurized by the processing chamber blower, said air supply pipe being coupled with the mixing chamber to allow the mixing of a combustible gas and pressurized air, the desiccant unit also having a desiccant wheel rotatable through the processing chamber and regeneration chamber;

a gas valve assembly having a pressurized mixing chamber, a threadedly adjustable gas valve with a gas nozzle being located within the pressurized mixing chamber and a gas inflow pipe and a gas outflow pipe, the gas inflow pipe is coupled to an existing gas supply with the inflow pipe also coupled to a line gas valve with the gas inflow pipe also coupling the gas line valve and the pressurized mixing chamber with the gas inflow pipe entering the mixing chamber and there coupling with the threadedly adjustable gas valve with a gas outflow pipe being coupled to the mixing chamber and passing into the regeneration chamber of the unit and there ending with a gas burner, the gas burner providing a source of heat to the gasses passing through the wheel and thereby regenerating the desiccant located on the surfaces of the wheel; and a plurality of ducts coupling the air handler and the manifolds and the desiccant unit.

* * * * *